US005746459A

United States Patent [19]

Giroux, Jr. et al.

[11] Patent Number: 5,746,459

[45] Date of Patent: May 5, 1998

[54] POWER DOOR LATCH METHOD AND APPARATUS

[75] Inventors: William H. Giroux, Jr., Kirtland; Charles E. Johnson, Farmington, both of N. Mex.

[73] Assignee: Independent Mobility Systems, Inc., Farmington, N. Mex.

[21] Appl. No.: 691,170

[22] Filed: Jul. 31, 1996

[51] Int. Cl.[6] ..... E05B 15/02

[52] U.S. Cl. ..... 292/341.16; 292/341.13

[58] Field of Search ..... 292/341.13, 341.15, 292/341.16, 341.18, 142, 144, DIG. 4, DIG. 41, DIG. 5, 340

[56] References Cited

U.S. PATENT DOCUMENTS

| | | | |
|---|---|---|---|
| 2,896,990 | 7/1959 | Garvey et al. | 292/229 |
| 2,903,288 | 9/1959 | Joachim et al. | 292/341.16 |
| 2,916,319 | 12/1959 | Du Bois | 292/341.16 |
| 4,135,377 | 1/1979 | Kleefeldt | 292/144 |
| 4,707,007 | 11/1987 | Inoh | 292/341.16 |
| 4,775,178 | 10/1988 | Boyko | 292/341.16 |
| 4,799,719 | 1/1989 | Wood | 292/144 |
| 4,892,340 | 1/1990 | Matumoto | 292/201 |
| 4,982,984 | 1/1991 | Yokota | 292/341.16 |
| 4,984,385 | 1/1991 | Deland | 292/341.16 |
| 5,058,939 | 10/1991 | Miilu | 292/DIG. 5 |
| 5,079,964 | 1/1992 | Hamada | 292/201 |
| 5,441,315 | 8/1995 | Kleefeldt et al. | 292/201 |

*Primary Examiner*—Rodney M. Lindsey
*Assistant Examiner*—Gary Estremsky
*Attorney, Agent, or Firm*—Dennis F. Armijo

[57] ABSTRACT

A power door latch that eliminates the need to slam a door and that also allows the required two stage lock to engage. The OEM striker once engaged is driven toward the door frame in a linear motion, by a reversible electric motor that drives an acme screw within the drive housing. Adjustable limit switches detect full closure and full open to activate and deactivate the motor. A mechanical delay is incorporated within the drive housing to allow the engagement of the two stage lock mechanism. The power door latch can be used with any OEM striker in most vehicles. Additionally, the power door latch can be manually engaged in the event of a power failure.

12 Claims, 6 Drawing Sheets

POWER DOOR LATCH METHOD AND APPARATUS

BACKGROUND OF THE INVENTION

1. Field of the Invention (Technical Field)

The invention relates to a power door latching and locking mechanism and more particularly to a method and apparatus for latching, locking and sealing a motor vehicle door.

2. Background Art

Electric or pneumatic closures devices for motor vehicle doors are well known in the art. However, most known devices cannot adequately function with new legal requirements to positively lock doors in two stages. Secondly, with the sliding automotive door and new weatherseal designs, existing systems do not produce the amount of force required to compress the weatherseal. Thus, the high reactive compression force of a weatherseal, the low speed and active torque generated by closer devices, and a multitude of other restrictive influences, will not allow the door latching mechanism to fully engage.

The deficiencies of the present devices is felt especially by the physically challenged. The addition of an electrically powered, side sliding door operator on their vehicles is a necessity. Unfortunately, the various methods employed today seriously compromise the safety and security of these individuals and their passengers. No door operator system currently available is capable of completely latching, locking and sealing the side sliding door every time.

The present invention can be added to most vehicle structures with minimal modification and will interface with all aftermarket door operators available today. The invention does not compromise the originally equipped door latch mechanism, retaining all the safety aspects throughout. Variations upon these devices proliferate in the prior art.

U.S. Pat. No. 2,916,319, to Du Bois, entitled Deck Lid Locking Mechanism, U.S. Pat. No. 4,892,230, to Matumoto, entitled Electric Locking Device For Lid, U.S. Pat. No. 2,903,288, to Joachim, et al., entitled Latch Striker Mechanism and U.S. Pat. No. 2,896,990, to Garvey, et al., entitled Vehicle Closure Latch, disclose devices that are limited to use with hinged lids or doors and cannot be used with sliding doors. Additionally, these devices are latch and lock devices utilizing a unacceptable single stage design and do not use OEM mechanisms.

U.S. Pat. No. 4,775,178, to Boyko, entitled Final Closing Device For Closure Member On A Vehicle, discloses a cam device for using a rotational force to pull the striker into a closed position. Secondly, this device does not allow the two stage latch design from engaging. OEM equipment cannot be used so the entire system must be exchanged. Finally, there is no adjustment for setting the fully open or closed positions of the door.

U.S. Pat. No. 4,707,007, to Inoh, entitled Striker Means For Automotive Door Latch Assembly, discloses a device similar to that of Boyko. This is a cam driven device that uses rotational force instead of linear to drive the striker, has no adjustment for either end of the spectrum and does not allow the two stage lock to engage.

None of the prior art, however, discloses a linear force for moving the striker, a designed delay for allowing the required two stage lock to engage and adjustments for a fully open or closed position.

SUMMARY OF THE INVENTION (DISCLOSURE OF THE INVENTION)

In accordance with the present invention, there is provided an apparatus and method for latching, locking and sealing a motor vehicle door using the OEM striker and for allowing an OEM two stage latching mechanism to engage. The preferred power door latch comprises a housing mounted to the door frame. Within the housing is a gear head which is driven by a reversible D.C. motor. The gear head rotates an acme screw which in turn drives an acme nut in a linear direction. The acme nut comprises a cage which comprises a mechanical delay to allow the two stage locking mechanism to engage. Affixed to the cage is a carrier bracket for affixation of a OEM striker. The drive housing also comprises a first adjustable limit switch for adjusting a rear position of the carrier bracket and a second adjustable limit switch for adjusting a forward position of the carrier bracket.

The preferred method of the invention comprises the steps of sending a start motor signal from a first adjustable limit switch, starting a motor that drives a gear head, rotating an acme screw from the gear head, transferring the rotational movement from the acme screw to linear movement by an acme nut, providing a cage for the acme nut wherein the cage comprises a mechanical delay, driving a carrier bracket with the acme nut, driving an OEM striker affixed to the carrier bracket and stopping the motor by a second adjustable limit switch.

A primary object of the present invention is the provision of a power door latch that is universal for all type vehicles and uses OEM equipment.

Another object of the invention is the provision of a power door latch that meets or exceeds Federal Motor Vehicle Safety Standards (FMVSS) criteria.

Yet another object of the invention is the provision of a power door latch that allows the two stage locking mechanism to engage every time.

A primary advantage of the present invention is its flexibility and its universal application.

Another advantage of the invention is its safety.

Yet another advantage of the invention is that it is not striker specific, therefore can be used with most OEM strikers.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
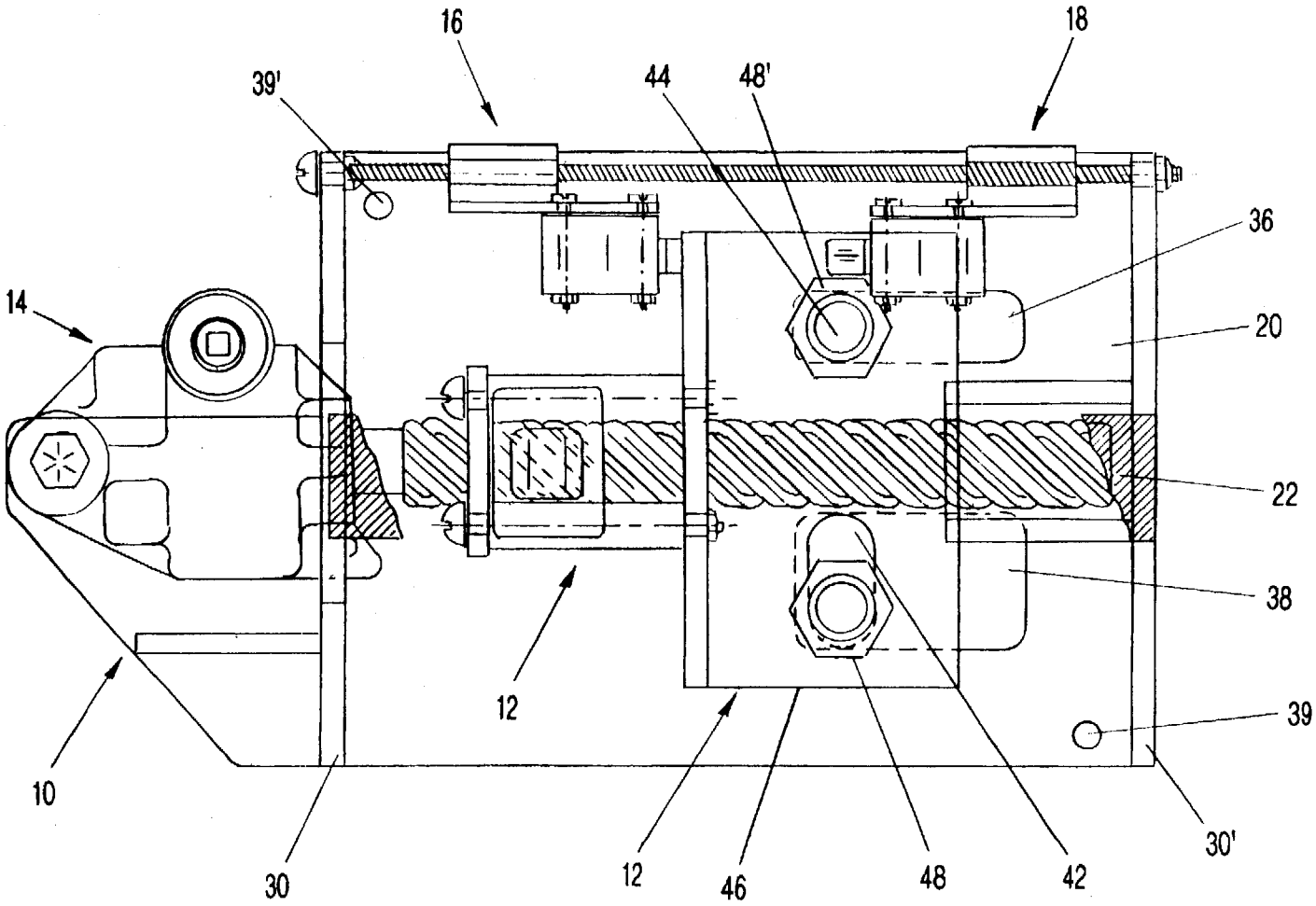
FIG. 1 is a front view of the preferred embodiment of the invention.

The invention is classified into six (6) unique sub-assemblies as shown in FIG. 1. Drive housing 10 is a boxlike structure, serving as the frame for sub-system component attachment. Striker carrier assembly 12, is an integral unit with six (6) different components and serves as a slave driven assembly and coupler for the door striker. Drive mechanism 14 is a gear reduction head and acme screw assembly. Limit carrier assemblies 16 and 18 are for system adjustment.

Figure 2:
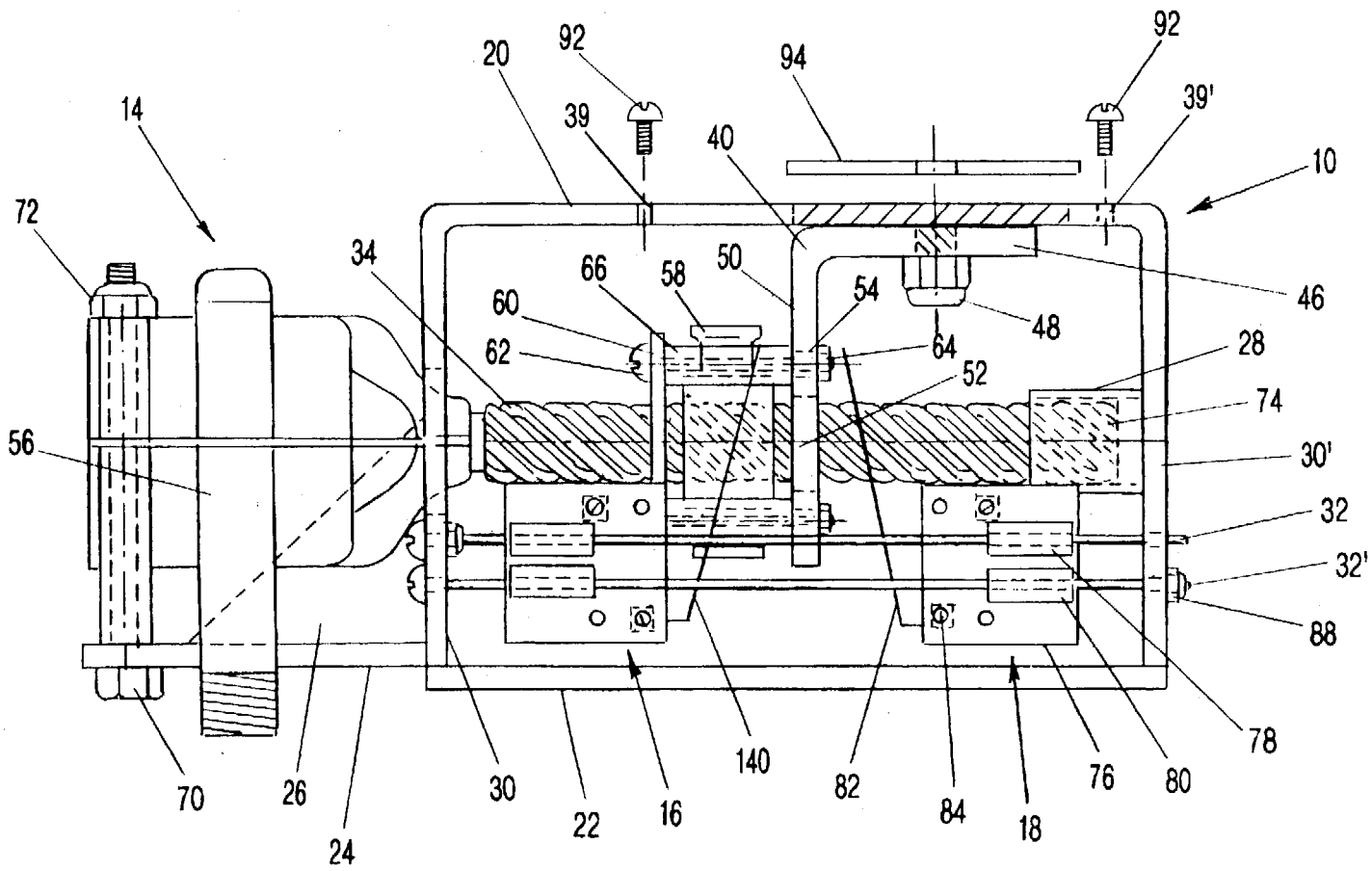
FIG. 2 is a top view of the embodiment of FIG. 1.
Figure 3:
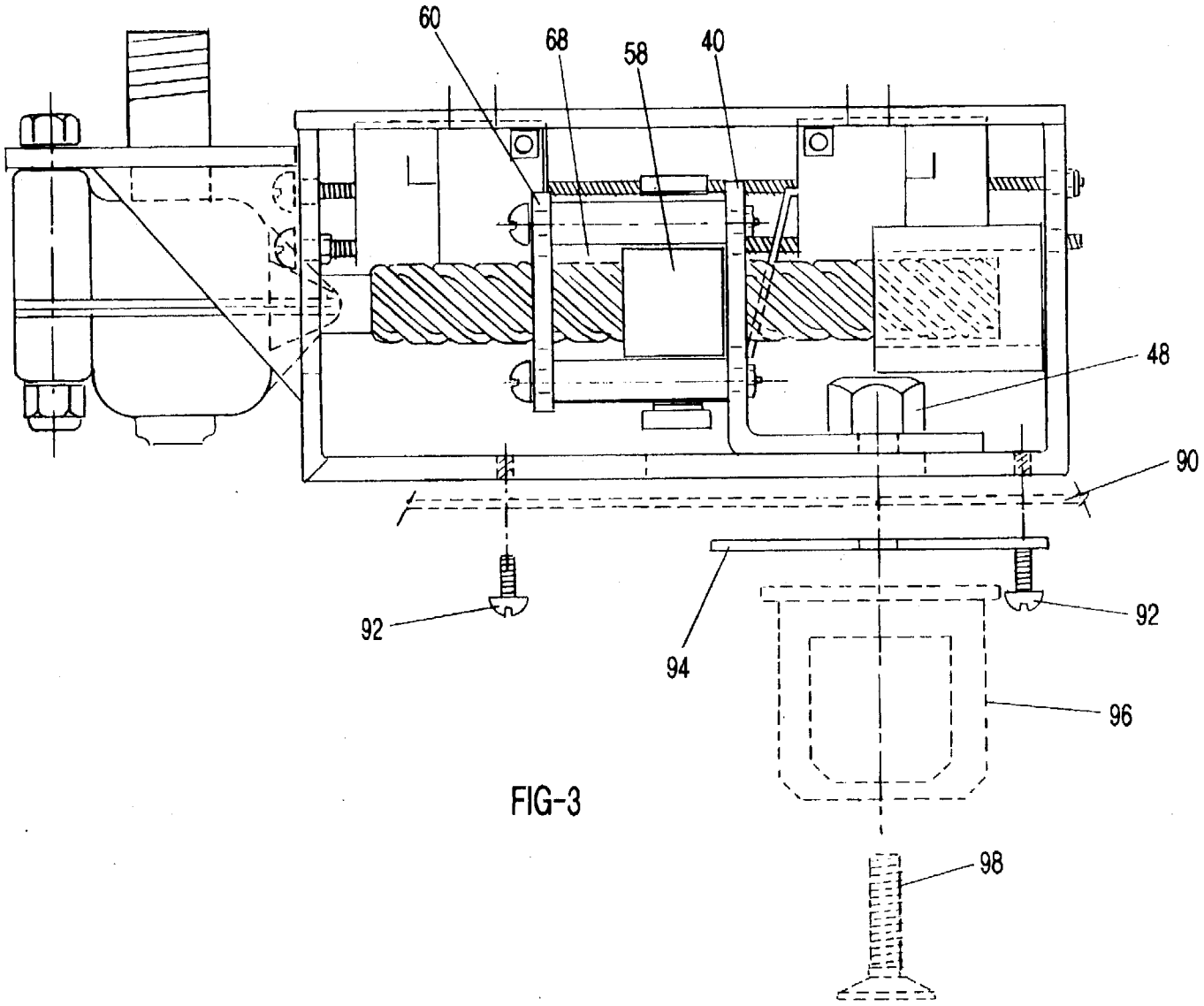
FIG. 3 is a side view of the preferred embodiment of the invention attached to the vehicle structure
Figure 4:
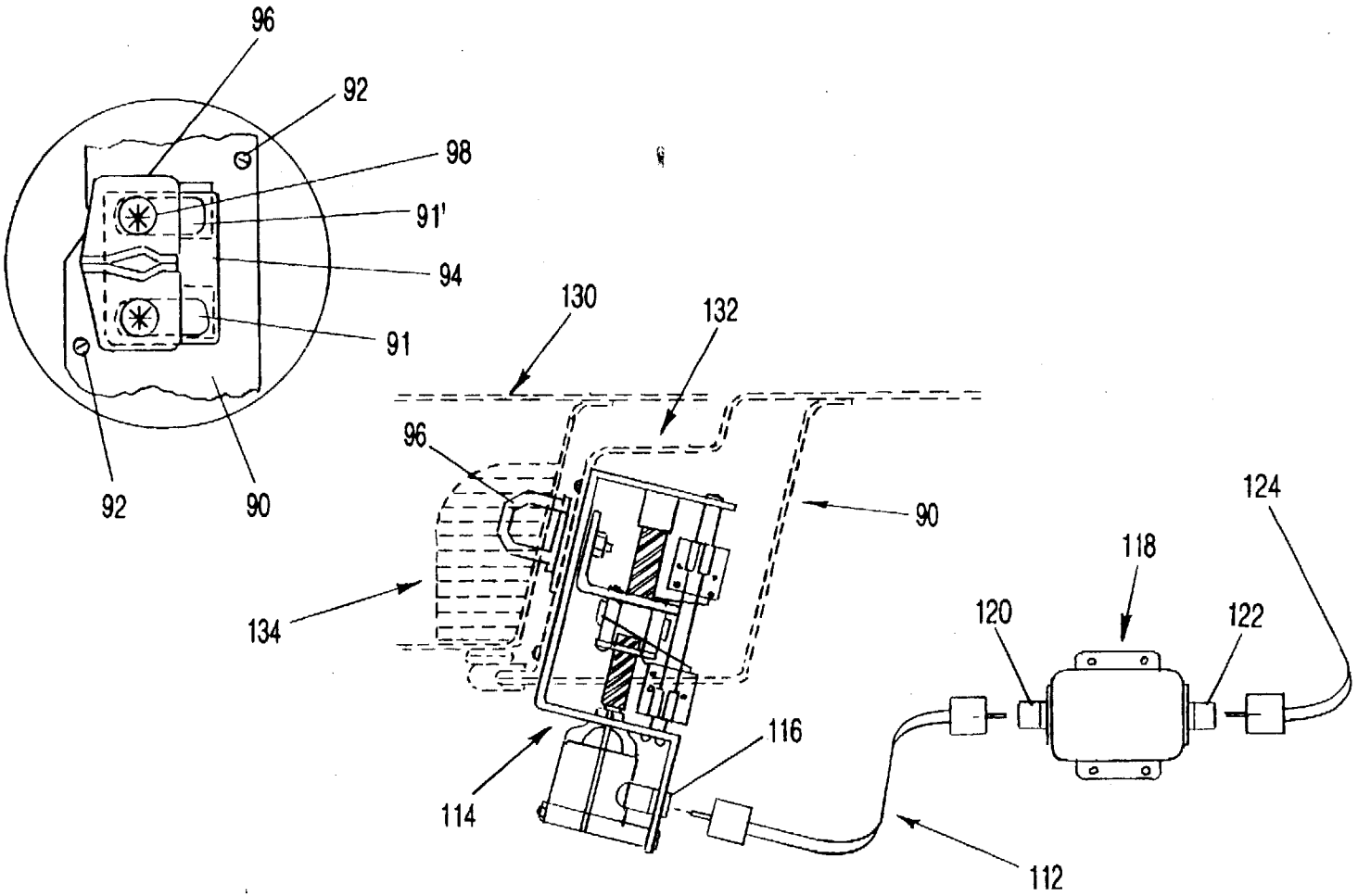
FIG. 4 is an overhead view of the preferred embodiment installed onto the vehicle structure.

Drive housing 10 is preferably fabricated from welded components, housing cover 20, housing reinforcement 22, gear head mount 24, head mount gusset 26 and receiver tube 28 as shown in FIG. 2. Housing cover 20 is preferably a machined steel plate, or the like, formed with perpendicular and equilateral end walls 30 and second end wall 30'. End wall 30 serves as means for external attachment of gear head mount 24 and head mount gusset 26. In addition, end wall 30 serves to positively locate adjuster screws 32 and 32'. These adjuster screws 32 and 32' adjust the limit carriers 16 and 18 of FIG. 1. Referring back to FIG. 2, head mount 24 is preferably located perpendicular to the outside edge of end wall 30 and permanently affixed by conventional welding methods, or other well known affixing means. Contiguous along two sides, head mount gusset 26 adjoins both the end wall 30 and gear head mount 24 laterally, and is preferably affixed at all points of contact by welding. Opposite and parallel to end wall 30, second end wall 30' serves as means for internal attachment of receiver tube 28 and second locator position of adjuster screws 32 and 32'. Receiver tube 28 is located perpendicularly on the inside face of second end wall 30', axial to acme screw 34. Attachment of receiver tube 28 to second end wall 30' preferably is also by welding. Located within the parameter of the housing cover 20, two (2) quadrilateral slots 36 and 38 as shown in FIG. 1, of different widths, are machined. To effect coupling of the striker bolts 98 of FIG. 3 and striker nuts 48 and 48' the varying widths of quadrilateral slots 36 and 38 allow for different striker mounting profiles or techniques between vehicle manufacturers, (not shown). Also within the housing cover 20, are two (2) tapped apertures 39 and 39' situated diagonally across from each other for subsequent mounting of the completed device onto a vehicle structure as shown in FIG. 4. To complete the drive housing 10 and housing reinforcement 22 is affixed onto end wall 30 and second end wall 30', near the drive housing 10 centerline and welded as depicted in FIG. 1.

Striker carrier assembly 12 in FIG. 1 is detailed in FIG. 2. Carrier bracket 40 is a perpendicularly formed metal for component attachment and provides the transitional means from a vertical to horizontal plane. As shown in FIG. 1, two (2) apertures 42 and 44 located on the leading face of the bracket 46, assimilate apertures 36 and 38 in adjoining housing cover 20. Elongated aperture 42 is longitudinally located and allows for specific placement of striker nut 48 and 48' to accommodate different striker mounting profiles, as shown in FIG. 1. The adjacent perpendicular face 50, FIG. 2 of carrier bracket 40 contains five (5) apertures. Acme screw shaft aperture 52 at the center axis allows the acme screw shaft 34 to traverse the assembly, and four (4) mounting apertures 54 to effect mounting of the remaining components. Perpendicular face 50 of carrier bracket 40, parallel to gear reduction head 56, as depicted in FIG. 2 serves as contact point for acme nut 58, later discussed. Back plate 60 also contains five (5) similar apertures, axially aligned and for the same purpose as those in carrier bracket 40.

Attachment of back plate 60 to carrier bracket 40 is preferably accomplished with four (4) machine screws 62 and nuts 64. Back plate 60 is separated laterally to carrier bracket 40 by four (4) perpendicularly mounted spacers 66. Spacers 66 are preferably of nylon or similar material. Assembled, carrier bracket 40 and back plate 60 are located laterally adjacent to acme nut 58. Nylon spacers 66 are located longitudinally to each side of vertical projections from acme nut 58.

This arrangement effectively creates an open frame "cage" wherein acme nut 58 is loosely fitted, providing for axial or radial misalignment between parts. Nylon spacers 66, to each side of the vertical projections of the acme nut 58 prevents it from rotating when acme screw 34 is in motion. Carrier bracket 40 and back plate 60 prevent longitudinal displacement of acme nut 58. Furthermore, the specified length of nylon spacers 66 and subsequent separation of carrier bracket 40 and back plate 60, imparts a mechanical delay in the operation of the assembly. That is, upon rotation of acme screw 34, acme nut 58 immediately travels in a longitudinal direction pursuant to the rotation, but must first expend the open space existing between it and the adjacent parallel surface, i.e., the carrier bracket 40 or back plate 60, depending on the direction of rotation of acme screw 34. This momentarily "stalls" movement of striker carrier assembly 12 of FIG. 1, which would otherwise cause improper latching of the door by only locking the first stage lock in the required two stage locking system. By utilizing this mechanical delay, both stages of the locking system are engaged every time. Only after the space is expended, does acme nut 58 contact the surface of either carrier bracket 40 or back plate 60 and physical movement of striker realized (not shown). FIG. 3 more clearly shows the mechanical delay space 68. Compare location of amce nut 58 in FIGS. 1, 2 & 3. Referring to FIGS. 1 and 2, to complete the striker carrier assembly 12, two (2) self-locking nuts 48 and 48' are preferably affixed to carrier bracket 40 by conventional welding. Placement thereof is contingent upon the OEM striker mounting profile.

Drive mechanism 14, FIG. 1 comprises of a gear reduction head 56 and internally coupled acme screw 34, FIG. 2. Gear reduction head 56 is attached to head mount bracket 24 with a head mount bolt 70 and head mount locking nut 72. The free end 74 of the acme screw 34 is contained within receiver tube 28, whereas radial oscillation of acme screw 34 is minimized. Acme nut 58, threaded onto acme screw 34, couple striker carrier assembly 12 to drive mechanism 14, as shown in FIGS. 1 and 2.

Mounted adjacent and parallel to striker carrier assembly 12 and drive mechanism 14, are limit carrier assemblies 16 and 18. Referring to FIG. 2, carrier plate 76 has welded to it, one (1 ) internally threaded coupler 80 and one (1) non-threaded coupler guide 78, placed longitudinally on carrier plate 76 and parallel to each other, as shown. Internally treaded coupler 80 is for longitudinal adjustment of the completed limit carrier assemblies 16 and 18 and affixes the assemblies by adjustment screws 32 and 32'. Non-threaded coupler guide 78 functions to maintain a horizontal position for limit carrier assemblies 16 and 18, adjacent to striker carrier assembly 12 of FIG. 1. Miniature limit switch 82 of FIG. 2, which can be a lever operated design or the like, is subsequently attached to carrier plate 76 with carrier screw and carrier nut 84. Two (2) assemblies are located within housing cover 20 and are "mirrored" of each other as shown. Limit carrier 16 is coupled to adjustment screw 32 of FIG. 2 and controls the rear position of striker carrier 12 as shown in FIG. 1. Limit carrier 18 is coupled to adjustment screw 32' and controls the forward position of striker carrier 12. Adjustment screws 32 and 32' are prevented from dislodging from housing cover 20 adjustment screw lock nuts 88. Each limit carrier assembly 16 and 18 is independently and infinitely adjustable within the housing cover 20. Actuation of miniature limit switch 82 is realized through physical contact with perpendicular face 50 of carrier bracket 40, as depicted in FIG. 2.

Figure 5:
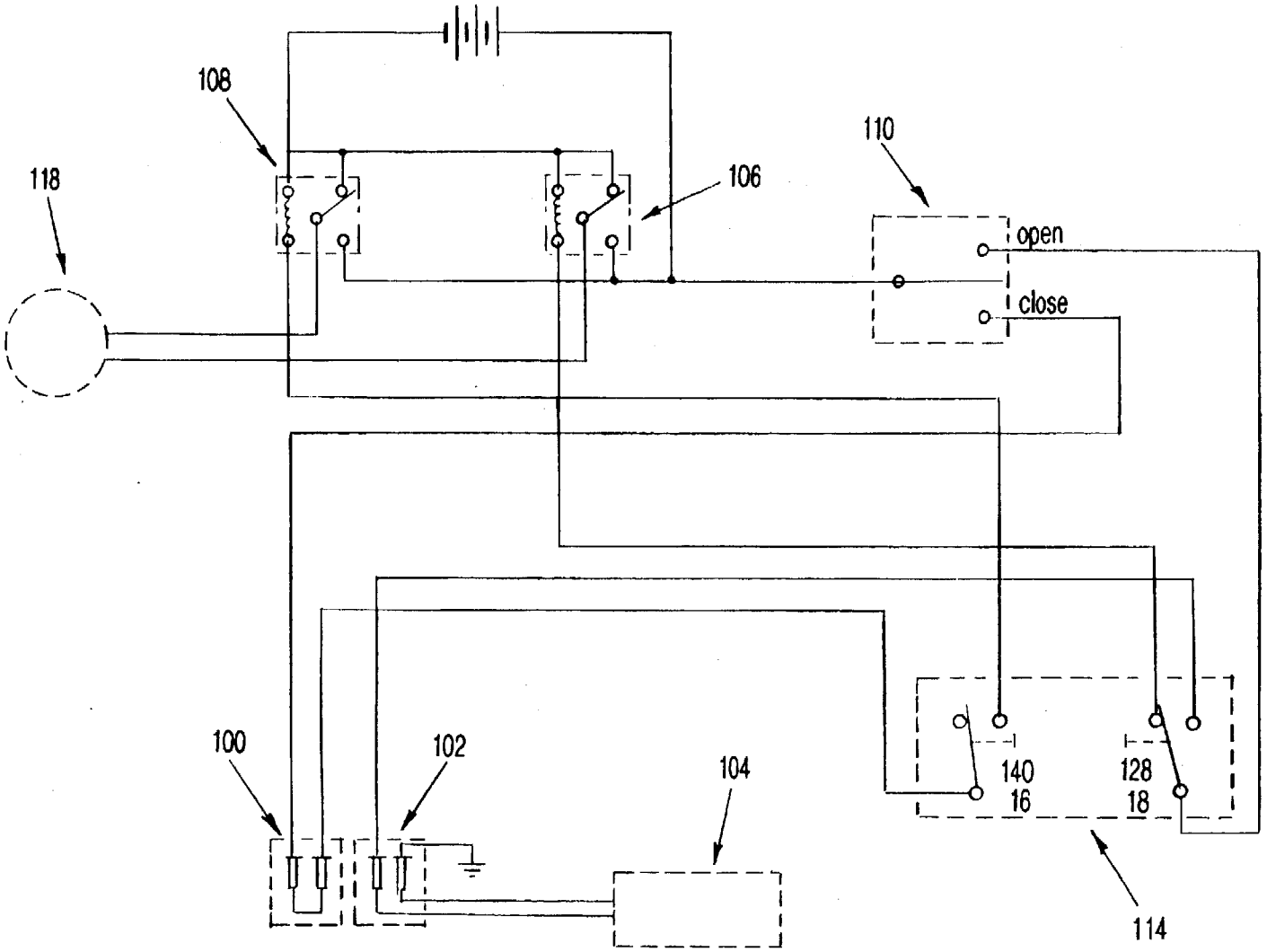
FIG. 5 is a schematic diagram of the preferred electrical circuit for operating the power door latch.
Figure 6A:
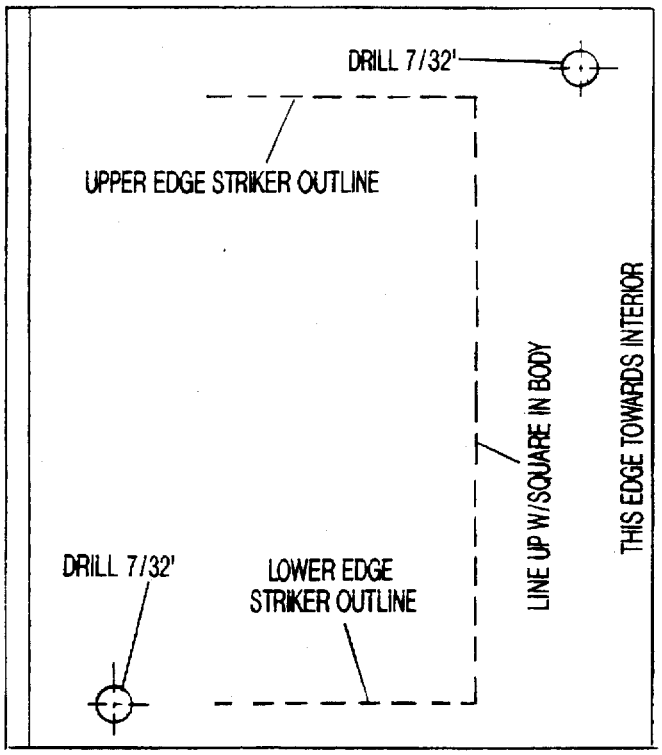
FIG. 6 is a template representative of a typical installation of an OEM striker.
Figure 6B:
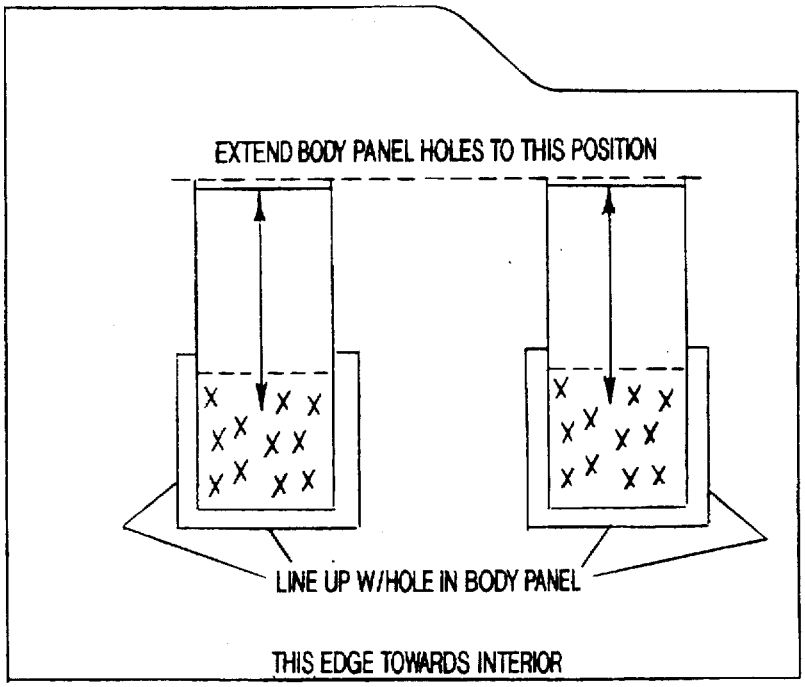

Referring to FIGS. 4 and 5, installation of the preferred embodiment of the invention into a vehicle structure is as follows: 1) the OEM door striker location is noted and appropriately marked upon the vehicle body. 2) A template, similar to the one shown in FIG. 6, is overlaid on the marked striker location, referencing extended body panel apertures adjustment slots and device mounting apertures locations. 3) The OEM striker apertures 91 and 91', FIG. 4, in the vehicle body are elongated using conventional tools of the art and power door latch assembly mounting apertures 92 are located and drilled. 4) The assembly is affixed to the interior vehicle structure 90 by two (2) stainless steel mounting screws 92, FIG. 3. 5) A fluorocarbon polymer such as a TEFLON ® seal 94 is placed upon the exterior striker location and OEM striker 96 placed on top of TEFLON ® seal 94. 6) OEM striker mounting bolts 98 are installed through OEM striker 96, TEFLON ® seal 94, vehicle body 90 and ultimately into striker locking nuts 48. 7) Striker bolts 98 are marginally tightened against OEM striker 96.

Though numerous electrical operating systems may be employed, a basis circuit is shown in FIG. 5 and comprises of two (2) pair of conventional door post contact switches 100 and 102, one (1) electrically operated door lock release solenoid 104, two (2) single pole double throw conventional automotive relays 106 and 108 and one (1) conventional single pole double throw control switch 110.

FIG. 4 shows the completed installation of the preferred embodiment of the invention. Flexible drive cable 112 between the power door latch assembly 114 gear head cable receiver 116 and a remotely mounted reversible DC motor 118 and power take off PTO connector 120. Also shown is a second PTO connector 122 for optional use of a remotely mounted, manually operated crank 124, in case of electrical power failure.

The operation of the preferred embodiment of the invention is as follows:

To open a door:

1) Electric signal from control switch 110, FIG. 5, completes circuit through normally closed contact of limit carrier 2 18, limit switch 2 128. A signal is sent to open relay 106 whereby relay contact transfers current to latch motor 118.
2) Latch motor 118 starts and through flexible drive cable 112 and gear head 116, begins counter-clockwise rotation of acme screw 34, FIG. 2.
3) Acme nut 58 thrusts longitudinally to the right side of housing cover 20, contacting striker carrier bracket 40. Striker carrier assembly 12, FIG. 1 in turn is moved to the right. With sliding door 130 locked onto striker 96, the aft end of sliding door 130 is pushed laterally, away from the C-post/door frame 132, FIG. 4.
4) Carrier assembly 12 of FIG. 1, continues to travel longitudinally right, and carrier bracket 40 comes into contact with lever of limit switch 82, which is adjustable for total carrier travel via adjustment screw 32' of FIG. 2. Limit switch 2 128, of FIG. 5, transfers electrical current to the normally open contact. Electric current deactivates relay 106, thus stopping motor rotation. The electric signal is sent to the closed contact of door post contact switch 102.
5) Door post contact switch 102 allows current to electrically operated lock solenoid 104. Lock solenoid 104 activates, in turn releasing OEM door latch 134 from striker 96 as shown in FIG. 4.
6) Sliding door 130 is released from latch striker 96, and can be moved rearward (opened), manually or by a powered operator device (not shown). A second limit switch (not shown) is placed in tandem with that of limit carrier assembly 18 of FIG. 1, will signal the powered operator automatically.
7) The invention being self-locking, striker 96 will remain at the outboard position until such time as a signal is received to reverse the procedure.

To close a door:

1) An electric signal from control switch 1 110 completes the circuit through the door post contact switch 100 of FIG. 5, prior to the sliding door's 130 of FIG. 4, complete closing and latching sequence.
2) Signal is sent to limit switch 140 assembly 16 in the latch apparatus 114. Limit switch 140 is normally closed so the signal is passed to the close relay coil 108.
3) Close relay 108 contacts transfer the electric current to latch motor 118, wherein latch motor 118 starts and through flexible drive cable 112 and gear head 116 of FIG. 4, begins clockwise rotation of acme screw 34 of FIG. 2. Still active, the powered door operator continues to move sliding door 130 forward and inward.
4) Acme nut 58 in FIG. 2, thrusts longitudinally to left side of housing cover 10, not imparting movement of striker carrier assembly 12 of FIG. 1, until such moment that it contacts back plate 60 of FIG. 2. Subsequently, sliding door 130 is allowed to fully engage the latching apparatus 134 onto striker 96 of FIG. 4.
5) Upon contacting back plate 60, acme nut 58 of FIG. 2, imparts movement to striker carrier assembly 12 of FIG. 1, longitudinally to the left. With sliding door 130 locked onto striker 96, aft end of the sliding door 130 is pulled laterally, toward C-post/door frame 132, FIG. 4.
6) Referring to FIGS. 1 and 2, carrier assembly 12, continues to travel longitudinally left and carrier bracket 40 comes into contact with lever of limit assembly 16, adjustable for total travel via adjustment screw 32. Limit switch 1 140 of FIG. 5 opens the circuit to close relay 108, interrupting current flow to latch motor 118.
7) The power door latch assembly 114 is self-locking therefore, striker carrier assembly 12 remains at the left position, thus retaining sliding door 130 in the closed position.
8) Should electrical power be interrupted, sliding door 130 may be closed by means of a remotely mounted, manually operated crank 124.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. A power door closing mechanism for use with an original equipment latch mechanism on motor vehicle doors comprising:

a reversible D.C. motor; and a housing adapted to be affixed to the motor vehicle door frame comprising:

a drive apparatus powered by said D.C. motor;

a rotating structure driven by said drive apparatus;

a means for changing rotational movement in said rotating structure into linear movement in a linear structure;

a striker affixed to said linear structure; and a mechanical delay means for allowing the striker to remain stationary after rotation of the rotating structure begins so as to allow adequate time for the latch mechanism to fully engage with the striker before linear movement of the striker begins.

2. The invention of claim 1 wherein said reversible D.C. motor comprises an adjustable start motor switch and an adjustable stop motor switch both comprising adjuster screws and limit carriers for controlling a position of a striker carrier.

3. The invention of claim 1 wherein said means for changing rotational movement to linear movement comprises an acme screw and an acme nut.

4. The invention of claim 3 wherein said acme screw is rotated by said drive apparatus.

5. The invention of claim 3 wherein said striker is affixed to said acme nut.

6. The invention of claim 1 wherein said striker comprises an original equipment manufacturer striker.

7. The invention of claim 1 wherein said delay means comprises an adjustable delay means for varying a time delay of said start of said linear movement.

8. A method of closing a door using a power door closing mechanism for use with an original equipment latch mechanism on motor vehicle doors, the method comprising the steps of:

a) activating a reversible D.C. motor;

b) rotating a structure with the D.C. motor;

c) changing a rotational movement of the rotating structure into linear movement in a linear structure; and d) operating a mechanical delay means for delaying a start of the linear movement for a predetermined amount of time to allow adequate time for the latch mechanism to fully engage with a striker affixed to the linear structure before the linear movement begins.

9. The method of claim 8 wherein the step of activating comprises providing an adjustable start motor switch and an adjustable stop motor switch for controlling a position of the striker.

10. The method of claim 8 wherein the step of changing rotational movement to linear movement comprises rotating an acme screw through an acme nut.

11. The method of claim 10 wherein the step of rotating an acme screw comprises rotating the acme screw with the rotating structure.

12. The method of claim 10 wherein the step of operating a mechanical delay means comprises adjust the start of the linear movement by varying a travel distance of the acme nut before movement of the striker.

* * * * *